US008603956B2

(12) United States Patent
Spala

(10) Patent No.: US 8,603,956 B2
(45) Date of Patent: Dec. 10, 2013

(54) SUPER OVERBASED POLYALKENYL SULFONATE AND ALKYLARYL SULFONATE COMPOSITION AND PROCESS FOR MAKING THE SAME

(75) Inventor: Eugene E. Spala, Fairfield, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 1967 days.

(21) Appl. No.: 11/279,505

(22) Filed: Apr. 12, 2006

(65) Prior Publication Data

US 2007/0244017 A1 Oct. 18, 2007

(51) Int. Cl.
*C10M 159/12* (2006.01)

(52) U.S. Cl.
USPC ..... 508/391

(58) Field of Classification Search
USPC ..... 508/391, 401
See application file for complete search history.

(56) References Cited

U.S. PATENT DOCUMENTS

| | | | | |
|---|---|---|---|---|
| 4,086,170 | A | 4/1978 | De Clippeleir et al. | |
| 4,137,184 | A | 1/1979 | Bakker | |
| 4,880,550 | A | 11/1989 | Hunt | |
| 5,132,033 | A | 7/1992 | Jao et al. | |
| 5,384,053 | A | 1/1995 | Cane et al. | |
| 6,054,419 | A | 4/2000 | Le Coent | |
| 6,159,912 | A | 12/2000 | McDonald | |
| 6,204,226 | B1 | 3/2001 | Le Coent et al. | |
| 6,337,310 | B1 | 1/2002 | Campbell et al. | |
| 6,410,491 | B1 | 6/2002 | Harrison et al. | |
| 6,479,440 | B1 | 11/2002 | Le Coent | |
| 2003/0134756 | A1* | 7/2003 | Carrick et al. | 508/398 |
| 2004/0102336 | A1* | 5/2004 | Boffa | 508/199 |
| 2004/0102339 | A1* | 5/2004 | Aoyagi et al. | 508/390 |
| 2005/0059560 | A1 | 3/2005 | Meyer et al. | |
| 2005/0176593 | A1 | 8/2005 | Ward et al. | |
| 2005/0209110 | A1 | 9/2005 | Roski et al. | |

FOREIGN PATENT DOCUMENTS

| | | |
|---|---|---|
| EP | 0312312 A1 | 4/1989 |
| EP | 0312313 A1 | 4/1989 |

* cited by examiner

*Primary Examiner* — Taiwo Oladapo

(57) ABSTRACT

The present invention is directed to super overbased polyalkenyl sulfonate and alkylaryl sulfonate composition comprising (a) one or more super overbased polyalkenyl sulfonates and (b) one or more super overbased alkylaryl sulfonates wherein the total base number (TBN) of the sulfonate composition is greater than 400. The present invention is also directed to a process for preparing such super overbased polyalkenyl sulfonate and alkylaryl sulfonate composition.

13 Claims, 1 Drawing Sheet

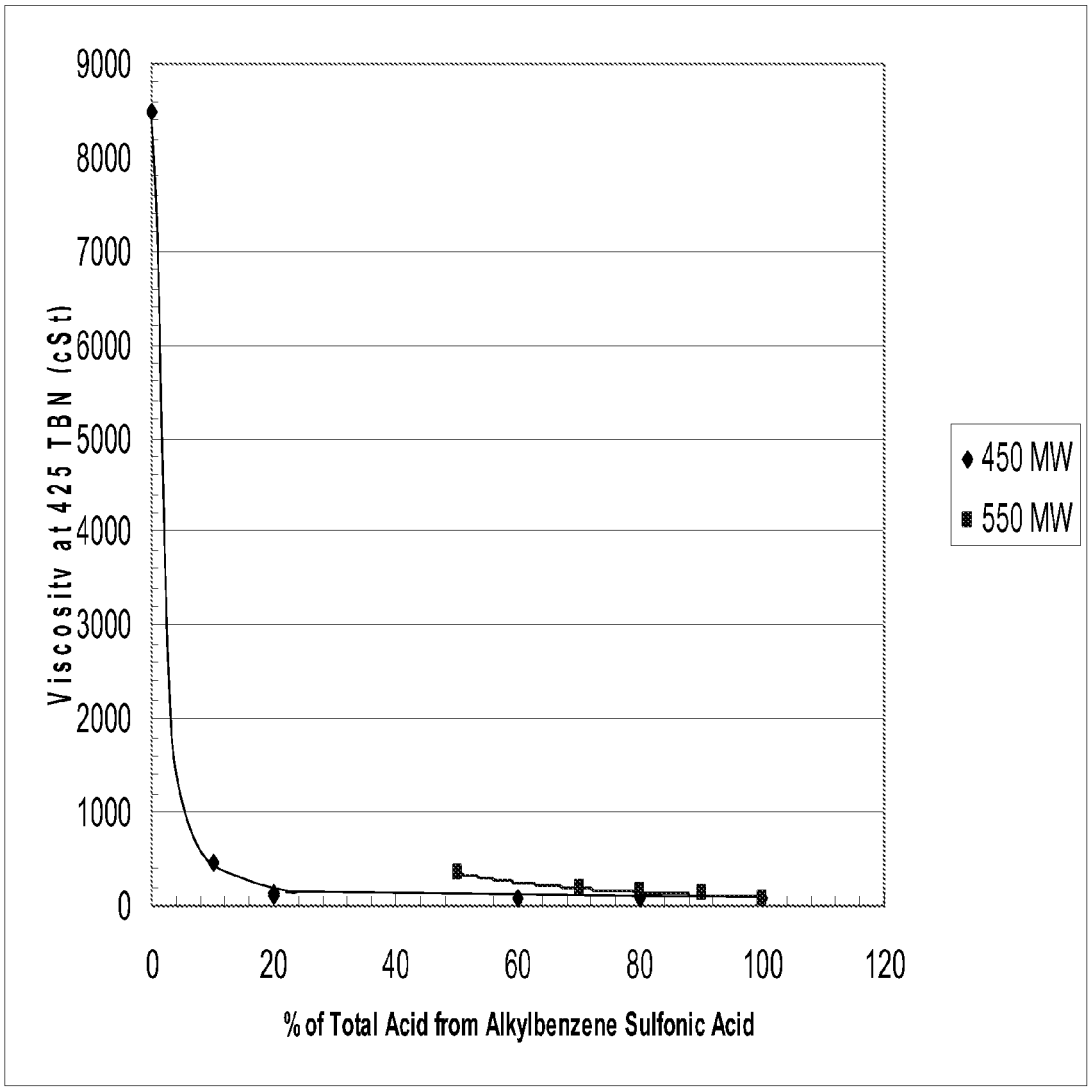
9000
8000
7000
6000
5000
4000
3000
2000
1000
0
Viscosity at 425 TBN (cSt)
0
20
40
60
80
100
120
% of Total Acid from Alkylbenzene Sulfonic Acid
450 MW
550 MW

SUPER OVERBASED POLYALKENYL SULFONATE AND ALKYLARYL SULFONATE COMPOSITION AND PROCESS FOR MAKING THE SAME

The present invention is directed to super overbased polyalkenyl sulfonate and alkylaryl sulfonate composition comprising (a) one or more super overbased polyalkenyl sulfonates and (b) one or more super overbased alkylaryl sulfonates wherein the Total Base Number (TBN) of the sulfonate composition is greater than 400. The present invention is also directed to a process for preparing such super overbased polyalkenyl sulfonate and alkylaryl sulfonate composition.

BACKGROUND OF THE INVENTION

Sulfonates are a class of chemicals used in household, industrial, and institutional cleaning applications, personal care and agricultural products, metalworking fluids, industrial processes, emulsifying agents, corrosion inhibitors and as additives in lubricating oils. Some of the desirable properties of sulfonates for use in lubricating oil applications include their low cost, compatibility, water tolerance, corrosion inhibition, emulsion performance, friction properties, high temperature stability, rust performance, and light color.

Sulfonates that are used in lubricating oil applications have been classified as either neutral sulfonates, low overbased (LOB) sulfonates, or high overbased (HOB) sulfonates.

High overbased polyalkenyl sulfonates having a TBN up to 400 are known and can be prepared by conventional overbasing processes. However, super overbased polyalkenyl sulfonates having a TBN greater than 400 that have acceptable viscosities are not known and a process for their preparation is also not known. There are many well known processes for preparing high overbased polyalkenyl sulfonates and high overbased alkylaryl sulfonates. A number of patents and patent applications have disclosed methods for preparing high overbased polyalkenyl sulfonates and high overbased alkylaryl sulfonates.

U.S. Pat. No. 4,086,170 discloses overbased calcium sulfonates and concentrated oily solutions thereof are prepared by reacting a solution of alkylbenzene sulfonic acid with an excess of a calcium oxide having a medium or low activity towards water and with carbon dioxide. Oily solutions of overbased calcium sulfonate obtained from such a calcium oxide are perfectly limpid and are easily filterable.

U.S. Pat. No. 4,137,184 discloses metal sulfonates of the formula R—$SO_3M$ wherein R is a hydrocarbyl and m is a Group I or Group II metal or lead are overbased with Group II metal carbonate, bicarbonate, oxide or hydroxide. Also provided are lubricating oil compositions or concentrates containing these overbased sulfonates.

U.S. Pat. No. 4,880,550 discloses a method for preparing a carbonate overbased calcium sulfonate, which method comprises the steps of: (1) forming an initial mixture of a lower molecular weight alkanol, an alkyl or alkaryl substituted sulfonic acid or sulfonate compound, a diluent and a solvent; (2) adding a basic calcium compound to the initial mixture to form a second mixture in which the amount of added calcium is at least about ten times the amount necessary to form a neutral calcium sulfonate; (3) heating the second mixture to reflux temperature; (4) carbonating the second mixture at said reflux temperature to form a carbonated product which simultaneously and continuously removing water produced by the carbonation reaction; (5) after carbonation is stopped, heating the carbonated product to an elevated temperature sufficient to remove the alkanol; and (6) removing solids and solvent from the carbonated product.

U.S. Pat. No. 5,132,033 discloses lubricating oil containing an overbased oil-soluble composition prepared by adding water to a heated reaction mixture containing an alkaline earth metal halide, an alkaline earth metal salt of an alkaryl sulfonate, a hydrocarbon diluent-solvent, a lower alkanol, and an alkali metal oxide, and thereafter passing carbon dioxide through the reaction mixture.

U.S. Pat. No. 5,384,053 discloses a process for the production of a lubricating oil additive concentrate comprises reacting at elevated temperature component (A) a calcium hydrocarbyl-substituted sulfonate, component (B) an alkaline earth metal base added either in a single addition or in a plurality of additions at intermediate points during the reaction, component (C) at least one compound which is (i) a polyhydric alcohol having 2 to 4 carbon atoms, (ii) a di-($C_3$ or $C_4$) glycol, (iii) a tri-($C_2$-$C_4$) glycol, (iv) a mono- or polyalkylene glycol alkyl ether, component (D) a lubricating oil, component (E) carbon dioxide added subsequent to the, or each addition of component (B), component (F) a defined carboxylic acid or derivative, component (G) at least one compound which is (i) an inorganic halide or (an ammonium alkanoate or a mono-, tri- or tetra-alkyl ammonium formate or alkanoate provided that, when component (G) is (it), component (F) is not an acid chloride.

U.S. Pat. No. 6,054,419 discloses mixtures of alkylaryl sulfonates of superalkalinized alkaline earth metals comprising: (a) 50 to 85% by weight of a mono-alkyl phenyl sulfonate with a $C_{14}$ to $C_{40}$ linear chain wherein the molar proportion of phenyl sulfonates substituent is position 1 or 2 is between 0 and 13%, and (b) 15 to 50% by weight of a heavy alkylaryl sulfonate, wherein the aryl radical is phenyl or not, and the alkyl chains are either two linear alkyl chains with a total number of carbon atoms of 16 40, or one or a plurality of branched alkyl chains with on average a total number of carbon atoms of 15 to 48. In as much as these mixtures contain less than 10% of linear mono-alkyl phenyl sulfonate substituted in position 1 or 2 of the linear alkyl chain, they exhibit properties making them fit for use as detergents/dispersant additives for lubricating oils.

U.S. Pat. No. 6,159,912 discloses a low overbased alkyl phenyl sulfonate prepared by the neutralization of sulfonic acid with a sulfurized high TBN calcium alkylphenate in the absence of chloride and in the absence of additional carboxylic acid.

U.S. Pat. No. 6,204,226 discloses mixture of alkyl phenyl sulfonates of alkaline earth metals having: (a) from 20% to 70% by weight of a linear mono-alkyl phenyl sulfonate in which the linear mono-alkyl substituent contains from 14 to 40 carbon atoms, preferably from 20 to 24 carbon atoms, and the mole % of the phenyl sulfonate radical fixed on positions 1 or 2 of the linear alkyl chain is between 10% and 25%, preferably between 13% and 20%, and (b) from 30% to 80% by weight of a branched mono-alkyl phenyl sulfonate in which the branched mono-alkyl substituent contains from 14 to 18 carbon atoms.

U.S. Pat. No. 6,337,310 B1 discloses an alkylaryl composition wherein the aryl radical is other than phenol and wherein the alkyl radical is derived from an isomerized $C_{14}$ to $C_{40}$ normal alpha olefin wherein either (1) the weight percent of the aryl radical fixed at position 1 or 2 of a linear alkyl chain is less than about 23 or (2) at least 28 weight percent of the alkyl radicals are branched chain alkyl radicals, or (3) both, and is useful for making alkaline earth alkylaryl sulfonates that can be used as lubricating oil additives.

U.S. Pat. No. 6,410,491 discloses a polyalkylene sulfonic acid composition comprising a mixture of polyalkenyl sulfonic acids derived from a mixture of polyalkylenes comprising greater than 20 mole percent alkyl vinylidene and 1,1-dialkyl isomers, and a method for making the composition. Also provided are low and high overbased sulfonates made from the mixture of polyalkenyl sulfonic acids, and lubricating oils containing the sulfonates.

U.S. Pat. No. 6,479,440 discloses an alkaline earth sulfonate having a BN of at least 250, wherein the aryl radical is not phenol, wherein the alkyl chain is a linear chain that contains between 14 and 40 carbon atoms, and wherein the mole % of the aryl-sulfonate radical fixed on positions 1 or 2 of the linear alkyl chain is between 13% and 30%. Such an alkaline earth alkylaryl sulfonate has improved compatibility, solubility and foaming performances while having low color and no skin formation. The starting alkylate has a low iodine number, a very high level of mono-alkylate, and as a consequence, a high yield at the sulfonation step.

U.S. patent application Ser. No. 10/714,469 (Publication No. US 2004/0102339 A1) discloses a method for improving the brake and clutch capacity of a functional fluid comprising adding a friction-modifying amount of a polyalkenyl sulfonate to the functional fluid, wherein the polyalkenyl sulfonate is an alkali metal or an alkaline earth metal salt of a polyalkylene sulfonic acid derived from a mixture of polyalkylenes comprising greater than about 20 mole percent alkyl vinylidene and 1,1-di-alkyl isomers.

U.S. patent application Ser. No. 10/660,948 (Publication No. US 2005/0059560 A1) discloses an improved process for making stabilized polyalkenyl sulfonic acids, whereby the product resulting from the reaction between a polyalkene and sulfur trioxide is stabilized by neutralizing with a neutralizing agent prior to storage or further processing. Neutralization at this point in the process results in polyalkenyl sulfonic acid that is stable and has decreased amount of sultones.

Super overbased polyalkenyl sulfonates are highly desirable for use in lubricating oils employable in diesel engines requiring a greater capability for neutralizing acidic matter, especially marine diesel engines. However, the conventional processes for the preparation of very highly overbased polyalkenyl sulfonates have problems associated with the very high, unacceptable viscosities of the products, which make them difficult to handle. Thus, there is a great need for a process for the preparation of overbased polyalkenyl sulfonates having a TBN greater than 400 and viscosities between 20 and 1,000 cSt at 100° C. Applicants have discovered a novel process for the preparation of polyalkenyl sulfonates having a TBN greater than 400, which process employs the addition of alkylaryl sulfonic acids or stabilized alkylaryl sulfonic acids to the polyalkylene sulfonic acids or the stabilized polyalkenyl sulfonic acids prior to the overbasing reaction.

It has surprisingly been found that the viscosity of the super overbased mixture of polyalkenyl sulfonates and alkylaryl sulfonates can be reduced 10 fold to 100 fold compared to the corresponding super overbased 100 percent polyalkenyl sulfonates when the overbased polyalkenyl sulfonates are prepared as super overbased polyalkenyl sulfonate and alkylaryl sulfonate composition. The super overbased alkylaryl sulfonate and polyalkenyl sulfonate composition is suitable for use in lubricating oil compositions requiring a high alkalinity reserve.

SUMMARY OF THE INVENTION

The present invention is directed to a super overbased polyalkenyl sulfonate and alkylaryl sulfonate composition comprising (a) one or more super overbased polyalkenyl sulfonates and (b) one or more super overbased alkylaryl sulfonates wherein the Total Base Number (TBN) of the sulfonate composition is greater than 400. The present invention is also directed to a process for preparing such super overbased polyalkenyl sulfonate and alkylaryl sulfonate composition. The present invention is also directed to lubricating oil compositions and concentrates containing the super overbased polyalkenyl sulfonate and alkylaryl sulfonate composition comprising (a) one or more super overbased polyalkenyl sulfonates and (b) one or more super overbased alkylaryl sulfonates wherein the Total Base Number (TBN) of the sulfonate composition is greater than 400.

More specifically the present invention is directed to a super overbased polyalkenyl and alkylaryl sulfonate composition comprising:

(a) one or more super overbased polyalkenyl sulfonates; and (b) one or more super overbased alkylaryl sulfonates;

wherein the Total Base Number (TBN) of the sulfonate composition is greater than 400.

Preferably the TBN of the super overbased polyalkenyl and alkylaryl sulfonate composition of the present invention is greater than 425, and more preferably the TBN of the super overbased polyalkenyl and alkylaryl sulfonate composition is greater than 450.

Preferably the super overbased polyalkenyl sulfonate and alkylaryl sulfonate composition of the present invention has a viscosity in the range from about 20 to about 1,000 cSt at 100° C. and has a TBN of 425 (the TBN of the mixtures was adjusted to 425 before the determination of the viscosity). More preferably the super overbased polyalkenyl and alkylaryl sulfonate composition has a viscosity in the range from about 40 to about 750 cSt at 100° C. and has a TBN of 425. Most preferably the super overbased polyalkenyl and alkylaryl sulfonate composition has a viscosity in the range from about 60 to about 500 cSt at 100° C. and has a TBN of 425.

The super overbased polyalkenyl sulfonate and alkylaryl sulfonate composition of the present invention is an alkali metal or alkaline earth metal salt, or mixtures thereof. Preferably super overbased polyalkenyl sulfonate and alkylaryl sulfonate composition is an alkaline earth metal salt, and more preferably super overbased polyalkenyl sulfonate and alkylaryl sulfonate composition is a calcium salt.

Preferably the polyalkenyl sulfonates are salts of polyalkenyl sulfonic acids derived from a mixture of polyalkenes comprising greater than about 20 mole percent alkyl vinylidene and 1,1-dialkyl isomers.

More preferably, the alkyl vinylidene isomer is a methyl vinylidene isomer and the 1,1-dialkyl isomer is a 1,1-dimethyl isomer.

The polyalkene employed to prepare the polyalkenyl sulfonates of the present invention has a number average molecular weight of about 168 to about 5,000. Preferably the polyalkene has a number average molecular weight of about 350 to about 1,000. More preferably the polyalkene has a number average molecular weight of about 400 to about 600.

Preferably, the polyalkene is polyisobutene.

The aryl radical on the alkylaryl moiety of the alkylaryl sulfonates is a non-phenolic aromatic ring and the alkyl chain is a linear alkyl chain or branched alkyl chain containing from about 4 to about 40 carbon atoms. Preferably alkyl chain contains from about 12 to about 32 carbon atoms, and more preferably the alkyl chain contains from about 20 to about 24 carbon atoms. Most preferably the alkyl chain is a linear alkyl chain containing from about 20 to about 24 carbon atoms.

Preferably the aryl radical is phenyl or tolyl, more preferably the aryl radical is phenyl.

A further embodiment of the present invention is directed to a process for preparing a super overbased polyalkenyl sulfonate and alkylaryl sulfonate composition comprising (a) one or more super overbased polyalkenyl sulfonates and (b) one or more super overbased alkylaryl sulfonates, wherein the process comprises:

(a) preparing a mixture of (i) one or more polyalkenyl sulfonic acids, stabilized polyalkenyl sulfonic acids, or mixtures thereof, and (ii) one or more alkylaryl sulfonic acids, stabilized alkylaryl sulfonic acids, or mixtures thereof; and (b) reacting the mixture with a source of an alkali metal or an alkaline earth metal, a $c_1$ to $C_5$ alkanol and carbon dioxide in the presence of a solvent;

wherein the Total Base Number (TBN) of the sulfonate composition is greater than 400.

Preferably the TBN of the super overbased polyalkenyl sulfonate and alkylaryl sulfonate composition prepared by the process of the present invention is greater than 425, and more preferably the TBN of the super overbased polyalkenyl sulfonate and alkylaryl sulfonate composition is greater than 450.

Preferably the super overbased polyalkenyl sulfonate and alkylaryl sulfonate composition of the present invention has a viscosity in the range from about 20 to about 1,000 cSt at 100° C. and has a TBN of 425 (the TBN of the composition was adjusted to 425 before the determination of the viscosity). More preferably the super overbased polyalkenyl and alkylaryl sulfonate composition has a viscosity in the range from about 40 to about 750 cSt at 100° C. and has a TBN of 425. Most preferably the super overbased polyalkenyl and alkylaryl sulfonate composition has a viscosity in the range from about 60 to about 500 cSt at 100° C. and has a TBN of 425.

Preferably the metal in step (b) is an alkaline earth metal, and more preferably the alkaline earth metal is calcium.

Another embodiment of the present invention is directed to a lubricating oil composition comprising:

(a) a major amount of an oil of lubricating viscosity; and (b) a super overbased polyalkenyl sulfonate and alkylaryl sulfonate composition comprising (i) one or more super overbased polyalkenyl sulfonates and (ii) one or more super overbased alkylaryl sulfonates;

wherein the Total Base Number (TBN) of the sulfonate composition is greater than 400.

Preferably the TBN of the super overbased polyalkenyl sulfonate and alkylaryl sulfonate composition employed in the lubricating oil composition of the present invention is greater than 425, and more preferably the TBN of the super overbased polyalkenyl sulfonate and alkylaryl sulfonate composition is greater than 450.

Preferably the super overbased polyalkenyl sulfonate and alkylaryl sulfonate composition employed in the lubricating oil composition of the present invention has a viscosity in the range from about 20 to about 1,000 cSt at 100° C. and has a TBN of 425. More preferably the super overbased polyalkenyl sulfonate and alkylaryl sulfonate composition has a viscosity in the range from about 40 to about 750 cSt at 100° C. and has a TBN of 425. Most preferably the super overbased polyalkenyl sulfonate and alkylaryl sulfonate composition has a viscosity in the range from about 60 to about 500 cSt at 100° C. and has a TBN of 425.

The lubricating oil composition of the present invention may also contain one or more additives selected from one or more detergents, dispersants, viscosity index improvers, ashless sulfur extreme pressure agents, alkaline earth metal and alkali metal borated extreme pressure agents, molybdenum-containing extreme pressure agents, provided, pour point depressants, rust inhibitors, corrosion inhibitors, ash-containing friction modifiers, ashless friction modifiers, molybdenum-containing friction modifiers, metal deactivators, seal swell agents, demulsifiers and anti-foaming agents.

A further embodiment of the present invention is directed to a lubricating oil concentrate comprising:

(a) from about 10 weight percent to about 90 weight percent an oil of lubricating viscosity; and (b) a super overbased polyalkenyl sulfonate and alkylaryl sulfonate composition comprising (i) one or more super overbased polyalkenyl sulfonates and (ii) one or more super overbased alkylaryl sulfonates;

wherein the Total Base Number (TBN) of the sulfonate composition in (b) is greater than 400.

Preferably the TBN of the super overbased polyalkenyl sulfonate and alkylaryl sulfonate composition employed in the lubricating oil concentrate of the present invention is greater than 425, and more preferably the TBN of the super overbased polyalkenyl sulfonate and alkylaryl sulfonate composition is greater than 450.

Preferably the super overbased polyalkenyl sulfonate and alkylaryl sulfonate composition employed in the lubricating oil concentrate of the present invention has a viscosity in the range from about 20 to about 1,000 cSt at 100° C. and has a TBN of 425. More preferably the super overbased polyalkenyl sulfonate and alkylaryl sulfonate composition has a viscosity in the range from about 40 to about 750 cSt at 100° C. and has a TBN of 425. Most preferably the super overbased polyalkenyl sulfonate and alkylaryl sulfonate composition has a viscosity in the range from about 60 to about 500 cSt at 100° C. and has a TBN of 425.

The lubricating oil concentrate of the present invention may also contain one or more additives selected from detergents, dispersants, viscosity index improvers, ashless sulfur extreme pressure agents, alkaline earth metal and alkali metal borated extreme pressure agents, molybdenum-containing extreme pressure agents, provided, pour point depressants, rust inhibitors, corrosion inhibitors, ash-containing friction modifiers, ashless friction modifiers, molybdenum-containing friction modifiers, metal deactivators, seal swell agents, demulsifiers and anti-foaming agents.

Among other factors, the present invention is based on the surprising discovery that the viscosity of the super overbased polyalkenyl sulfonates can be reduced by the addition of small quantities of alkylaryl sulfonic acids or stabilized alkylaryl sulfonic acids to the polyalkenyl sulfonic acids or the stabilized polyalkenyl sulfonic acids during the overbasing process.

BRIEF DESCRIPTION OF THE DRAWINGS

FIG. 1 shows the viscosity of super overbased polyisobutene sulfonates, number average molecular weight (Mn) 450 and 550, and alkylbenzene sulfonates. The data plotted in FIG. 1 are also summarized in Tables II and III. The data show that the addition of increasing amounts of the alkylbenzene sulfonic acids to the stabilized polyisobutene sulfonic acids during the overbasing process results in an increasing amount of reduction in viscosity of the overbased sulfonate mixture.

DETAILED DESCRIPTION OF THE INVENTION

Definitions

As used herein the following terms have the following meanings unless expressly stated to the contrary:

The term "alkali metal" as used herein refers to Group I metals in the Periodic Table, such as sodium, potassium and lithium, or mixtures thereof.

The term "alkaline earth metal" as used herein refers to Group II metals in the Periodic Table, such as calcium, barium, magnesium, strontium, or mixtures thereof.

The term "alkaline earth alkylaryl sulfonate" as used herein refers to an alkaline earth metal salt of an alkylaryl sulfonic acid. In other words, it is an alkaline earth metal salt of an aryl that is substituted with (1) an alkyl group and (2) a sulfonic acid group that is capable of forming a metal salt.

The term "alkyl" as used herein refers to both linear chain and branched chain alkyl groups.

The term "alkylene" as used herein refers to linear-chain and branched-chain alkylene groups having at least 2 carbon atoms. Typical alkylene groups include, for example, ethylene ($—CH_2CH_2—$), propylene ($—CH_2CH_2CH_2—$), isopropylene ($—CH(—CH_3)CH_2—$), n-butylene ($—CH_2CH_2CH_2CH_2—$), sec-butylene ($—CH(CH_2CH_3)CH_2—$), n-pentylene ($—CH_2CH_2CH_2CH_2CH_2—$), and the like.

The term "di-alkylaryl hydrocarbon content" as used herein refers to the weight percentage of the alkylaryl hydrocarbon that is not mono-alkylaryl hydrocarbon [100× di-alkylaryl hydrocarbon/(mono-alkylaryl hydrocarbon+di-alkylaryl hydrocarbon)].

The terms "high overbased" or "HOB" as used herein refer to an overbased polyalkenyl or alkylaryl sulfonate having a high TBN of greater than about 60 to about 400. Generally a carbon dioxide treatment is required to obtain high TBN overbased detergent compositions. It is believed that this forms a colloidal dispersion of metal base.

The term "mono-alkylaryl hydrocarbon content" as used herein refers to the weight percentage of the alkylaryl hydrocarbon that is not di-alkylaryl hydrocarbon [100× mono-alkylaryl hydrocarbon/(mono-alkylaryl hydrocarbon+di-alkylaryl hydrocarbon)].

The terms "low overbased" or "LOB" as used herein refer to overbased polyalkenyl or alkylaryl sulfonate having a low TBN of about 0 to about 60.

The term "polyalkyl" or "polyalkenyl" as used herein refers to an alkyl or alkenyl group which is generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutene, 1-octene and 1-decene. Polyolefins prepared from such mono-olefins include polypropylene, polybutene, especially polyisobutene, and the poly-alpha-olefins produced from 1-octene and 1-decene.

The term "source of alkali metal or alkaline earth metal" as used herein refers to alkali metal hydroxides, oxides or alkoxides and alkaline earth metal hydroxides, oxides or alkoxides, or mixtures thereof.

The terms "stabilized polyisobutene sulfonic acids" or "stabilized alkylaryl sulfonic acids" as used herein refer to polyisobutene sulfonic acids and alkylaryl sulfonic acids that have been stabilized by neutralization with an alkali metal or alkaline earth metal. The degree of neutralization may be varied between 65 weight percent neutral polyisobutene sulfonic acid and alkylaryl sulfonic acid and 100 weight percent polyisobutene sulfonic acid and alkylaryl sulfonic acid. Preferably the degree of neutralization may be varied between 80 weight percent neutral polyisobutene sulfonic acid and alkylaryl sulfonic acid and 100 weight percent polyisobutene sulfonic acid and alkylaryl sulfonic acid.

The term "super overbased" as used herein refers to an overbased polyalkenyl sulfonate or alkylaryl sulfonate having a TBN of greater than 400. Generally a carbon dioxide treatment is required to obtain high TBN overbased detergent compositions. It is believed that this forms a colloidal dispersion of metal base.

The terms "Total Base Number" or "TBN" as used herein refer to the amount of base equivalent to the milligrams of KOH in 1 gram of sample. Thus, higher TBN numbers reflect more alkaline products and therefore a greater alkalinity reserve. The TBN of a sample can be determined by ASTM Test No. D2896 or any other equivalent procedure. In general terms, TBN is the neutralization capacity of one gram of the lubricating composition expressed as a number equal to the mg of potassium hydroxide providing the equivalent neutralization. Thus, a TBN of 10 means that one gram of the composition has a neutralization capacity equal to 10 mg of potassium hydroxide.

Unless otherwise specified, all percentages are in weight percent, all ratios are molar ratios, and all molecular weights are number average molecular weights.

As stated above, the present invention is directed to novel polyalkenyl sulfonate and alkylaryl sulfonate composition, wherein the TBN of the composition is greater than 400. The present invention is also directed to a process for making the novel polyalkenyl sulfonate and the alkylaryl sulfonate composition, wherein the TBN of the mixture is greater than 400. The polyalkenyl sulfonate and alkylaryl sulfonate composition may be an alkali metal or an alkaline earth metal salt, or mixtures thereof.

Polyalkenyl Sulfonic Acid

The polyalkenyl sulfonic acids employed in the process of the present invention to prepare the super overbased polyalkenyl sulfonates and alkylaryl sulfonates may be prepared by reacting a mixture of polyalkenes comprising greater than about 20 mole percent alkyl vinylidene and 1,1-dialkyl isomers with a source of sulfur trioxide $—SO_3—$. The source of $—SO_3—$ can be a mixture of sulfur trioxide and air, sulfur trioxide hydrates, sulfur trioxide amine complexes, sulfur trioxide ether complexes, sulfur trioxide phosphate complexes, acetyl sulfate, a mixture of sulfur trioxide and acetic acid, sulfamic acid, alkyl sulfates or chlorosulfonic acid. The reaction may be conducted neat or in any inert anhydrous solvent. The conditions for sulfonation are not critical. Reaction temperatures can range from about −30° C. to about 200° C. and depends on the particular sulfonating agent employed. For example, acetyl sulfate requires low temperatures for reaction and elevated temperatures should be avoided to prevent decomposition of the product. Reaction time can vary from a few minutes to several hours depending on other conditions, such as reaction temperature. The extent of the reaction can be determined by titration of sulfonated polyalkene after any free sulfuric acid has been washed out. Typical mole ratios of sulfonating agent to polyalkene can be about 0.8:1.0 to about 2.0:1.0.

The polyalkenes used to prepare the polyalkenyl sulfonic acid are a mixture of polyalkenes having about 12 to about 350 carbon atoms. The mixture comprises greater than about 20 mole percent, preferably greater than about 50 mole percent, and more preferably greater than about 70 mole percent alkylvinylidene and 1,1-dialkyl isomers. The preferred alkylvinylidene isomer is a methyl vinylidene isomer, and the preferred 1,1-dialkyl isomer is a 1,1-dimethyl isomer.

The polyalkenes have a number average molecular weight in the range of about 168 to about 5,000. Preferably, the polyalkenes have number average molecular weights of about 350 to about 2,300; more preferably, about 350 to about 1,000; and most preferably, about 350 to about 750.

The preferred polyalkene is polyisobutene. Especially preferred are polyisobutenes made using $BF_3$ as catalyst.

U.S. Pat. No. 5,408,018, which issued on Apr. 18, 1995 to Rath and which is incorporated by reference in its entirety, and the references cited therein describe a suitable process for the production of polyisobutenes that contain greater than about 20 mole percent alkylvinylidene and 1,1-dialkyl isomers.

Typically, when polyisobutenyl sulfonic acids or sulfonates are prepared from polyisobutene having a mole percent of alkylvinylidene and 1,1-dialkyl isomers greater than about 20% is used to prepare polyisobutenyl sulfonic acids or sulfonates, the molecular weight distribution of the resulting product has at least about 80% of the polyisobutenyl sulfonic acids or sulfonates whose molecular weights are separated by even multiples of about 56 daltons. In other words, less than about 20% of the polyisobutenyl sulfonic acids or sulfonates in the molecular weight distribution of the sulfonic acids or sulfonates contain a total number of carbon atoms that is not evenly divisible by about four.

The Polyalkenyl Sulfonate

The super overbased polyalkenyl sulfonates of the present invention are prepared as a super overbased mixture of polyalkenyl sulfonates and alkylaryl sulfonates by employing the process of the present invention discussed below.

Alkylaryl Sulfonic Acids

The alkylaryl sulfonic acids employed in the present invention may be prepared by subjecting the alkylaryl hydrocarbons described above to the sulfonation reaction.

Sulfonation is conducted by any sulfonation method known to a person skilled in the art. One sulfonation method that may be employed is described below. The alkylaryl hydrocarbons described above may be sulfonated using sulfur trioxide ($SO_3$), produced by the passage of a mixture of oxygen and sulfur dioxide ($SO_2$) through a catalytic furnace containing vanadium oxide ($V_2O_5$). The sulfur trioxide gas is introduced at the top of a sulfonation reactor in a concurrent alkylaryl stream. The resulting sulfonic acid is recovered at the bottom of the reactor. The sulfonation temperature is maintained between 50° C. and 60° C. After the sulfonation reaction, the residual sulfuric acid is removed by thermal treatment after dilution with 10% 100 Neutral oil.

Alkylaryl Hydrocarbons

The alkylaryl hydrocarbons that may be employed to prepare the alkylaryl sulfonates of the present invention are prepared by alkylation of the aryl group, phenyl or substituted-phenyl, such as tolyl, xylyl, ethyl phenyl or cumenyl.

The alkyl group may be a linear alkyl chain or branched alkyl chain containing from about 4 to about 40 carbon atoms. Preferably alkyl chain contains from about 12 to about 32 carbon atoms, and more preferably the alkyl chain contains from about 20 to about 24 carbon atoms. Most preferably the alkyl chain is a linear alkyl chain containing from about 20 to about 24 carbon atoms.

The alkyl group is a linear, long chain alkyl group, which gives a high mole percentage of the aryl sulfonate radical on position 1 or 2 of the linear alkyl chain. The linear alkyl chain contains between 14 and 40 carbon atoms, preferably from 20 to 28 or 20 to 24 carbon atoms. Preferably, the alkaline earth alkylaryl sulfonate is derived from a $C_{14}$-$C_{40}$ normal alpha olefin, more preferably from a $C_{20}$-$C_{28}$ or $C_{20}$-$C_{24}$ normal alpha olefin.

Such alkylaryl hydrocarbons may be mixed with other heavy alkylaryl hydrocarbons, such as di-alkyl benzene wherein the total carbon of the both alkyl chains is between $C_{14}$ and $C_{60}$, and preferably between $C_{18}$ and $C_{40}$; a mono or poly alkylaryl sulfonate in which the aryl radical may be a phenyl, or substituted-phenyl, such as tolyl, xylyl, ethyl phenyl or cumenyl, in which the alkyl groups are branched chain having a total number of carbons of at least on average 15 and up to 48; alkyl naphthalene, a petroleum fraction or polyisobutene having a molecular weight preferably between 400 and 2300. The alkyl chain of the alkylaryl hydrocarbon is coming from dehydrogenation of paraffin or from polymerization of ethylene, propylene, butene-1 or isobutene.

Stabilization of Polyalkylene Sulfonic Acids and Alkylaryl Sulfonic Acids

The polyalkylene sulfonic acids and the alkylaryl sulfonic acids described above may be stabilized by partial neutralization or total neutralization by any method known to a person skilled in the art. A method typically used is described below.

The sulfonic acids may be partially neutralized or totally neutralized in a diluent and water with an alkali metal or an alkaline earth metal, or an oxide or a hydroxide thereof, in the presence of an alcohol, and preferably with a carboxylic acid promoter, containing 1 to about 4 carbon atoms. The stabilized sulfonic acids are obtained after removal of the alcohol and water and filtration. The degree of neutralization may be varied between 65 weight percent neutral polyisobutene sulfonic acid and alkylaryl sulfonic acid and 100 weight percent polyisobutene sulfonic acid and alkylaryl sulfonic acid. Preferably the degree of neutralization may be varied between 80 weight percent neutral polyisobutene sulfonic acid and alkylaryl sulfonic acid and 100 weight percent polyisobutene sulfonic acid and alkylaryl sulfonic acid.

Carbonation and Overbasing of the Mixture of Polyalkylene Sulfonic Acids, Stabalized Polyalkenyl Sulfonic Acids, or Mixtures Thereof and Alkylaryl Sulfonic Acids, Stabalized Alkylaryl Sulfonic Acids, or Mixtures Thereof The polyalkylene and the alkylaryl sulfonic acids and/or the stabilized polyalkylene and the alkylaryl sulfonic acids were super overbased as described below.

Carbonation and overbasing of the mixture of polyalkylene sulfonic acids, stabilized polyalkenyl sulfonic acids, or mixtures thereof, and the alkylaryl sulfonic acids, stabilized alkylaryl sulfonic acids, or mixtures thereof, was conducted using a large excess of a source of an alkali metal or alkaline earth metal compared to the amount of sulfonic acid in the presence of an alcohol and a solvent. Carbonation was carried out using carbon dioxide at temperatures about 30° C. and up to 40° C. Solvent was removed by distillation and the sediment was removed by filtration. The resultant super overbased mixture of polyalkenyl and the alkylaryl sulfonates had a TBN greater than 400, preferably greater than 425, and more preferably greater than 450 as measured by ASTM D 2896.

The super overbased mixture of polyalkenyl sulfonates and alkylaryl sulfonates of the present invention are characterized by a metal content in excess of that which would be present according to the stoichiometry of the metal cation in the sulfonate said to be overbased. These super overbased polyalkenyl sulfonates and alkylaryl sulfonates contain amounts of metal in excess of that required to neutralize the sulfonic acids.

The alkali metal or alkaline earth metal can be introduced into the reaction mixture by any suitable means. One method comprises combining a basically reacting compound of the metal, such as the hydroxide, oxide or alkoxide with the mixture of polyalkenyl sulfonic acid, stabilized polyalkenyl sulfonic acid, or mixtures thereof, and alkylaryl sulfonic acid, stabilized alkylaryl sulfonate, or mixtures thereof. This is generally carried out in the presence of a hydroxylic promoter such as water, $C_1$ to $C_5$ alkanols such as 2-ethyl hexanol or methanol, and an inert solvent, typically with heating. Under these conditions, the basically reacting compounds will yield the metal sulfonates. The hydroxylic promoter and solvent can then be removed to yield the metal sulfonates. The preferred sulfonates are alkaline earth metal sulfonates, especially those of calcium, barium and magnesium. Most preferred are the calcium and magnesium sulfonates.

Applicants have discovered a novel process for the preparation of polyalkenyl sulfonates having a TBN greater than 400, which process employs the addition of alkylaryl sulfonic acids or stabilized alkylaryl sulfonic acids to the polyalkenyl sulfonic acids or the stabilized polyalkenyl sulfonic acids prior to the overbasing reaction. It has surprisingly been found that the viscosity of the super overbased mixture of polyalkenyl sulfonates and alkylaryl sulfonates can be reduced 10 fold to 100 fold compared to the corresponding super overbased 100 percent polyalkenyl sulfonates. The super overbased mixture of polyalkenyl sulfonates and alkylaryl sulfonates are suitable for use in lubricating oil compositions and concentrates requiring a high alkalinity reserve.

Lubricating Oil Composition

The lubricating oil composition of the present invention may be prepared by simple blending or mixing of the compounds described in more detail below. These compounds may also be preblended as a concentrate or package with various other additives in appropriate ratios to facilitate blending of a lubricating oil composition containing the desired concentration of additives.

Oil of Lubricating Viscosity

Oil of lubricating viscosity, or base oil as used herein refer to lubricating oils which may be mineral oil or synthetic oils of lubricating viscosity and preferably useful in the crankcase of an internal combustion engine. Crankcase lubricating oils ordinarily have a viscosity of about 1300 centistokes at −17.8° C. to 22.7 centistokes at 98.9° C. The lubricating oils may be derived from synthetic or natural sources. Mineral oil for use as the base oil in this invention includes paraffinic, naphthenic and other oils that are ordinarily used in lubricating oil compositions. Synthetic oils include hydrocarbon synthetic oils and synthetic esters. Useful synthetic hydrocarbon oils include liquid polymers of alpha-olefins having the proper viscosity. Especially useful are the hydrogenated liquid oligomers of $C_6$ to $C_{12}$ alpha-olefins such as 1-decene trimer. Similarly, alkyl benzenes of proper viscosity, such as di-dodecyl benzene, may be used. Useful synthetic esters include the esters of mono-carboxylic acids and polycarboxylic acids, as well as mono-hydroxy alkanols and polyols. Typical examples are di-dodecyl adipate, pentaerthritol tetracapoate, di-2-ethylhexyl adipate, di-laurylsebacate and the like. Complex esters prepared from mixtures of mono- and di-carboxylic acid and mono- and di-hydroxy alkanols can also be used. Blends of hydrocarbon oils and synthetic oils may also be used. For example, blends of 10 weight percent to 25 weight percent hydrogenated 1-decene trimer with 75 weight percent to 90 weight percent 683 centistokes at 37.8° C. mineral oil gives an excellent oil base. Fischer-Tropsch derived base oils may also be employed in the lubricating oil composition of the present invention.

Other Additive Components

The following additive components are examples of some of the components that can be favorably employed in the present invention. These examples of additives are provided to illustrate the present invention, but they are not intended to limit it:

Metal Detergents

In addition to the super overbased polyalkenyl sulfonates and alkylaryl sulfonates of the present invention, the lubricating oil may also contain other detergents, such as sulfurized or unsulfurized alkyl or alkenyl phenates, carboxylates, salicylates, phenolate, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic, acids, metal salts of an alkyl or alkenyl multi-acid, and chemical and physical mixtures thereof.

Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Anti-oxidants may include, but are not limited to, such anti-oxidants as phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butyldene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-1-4-methylphenol, 2,6-di-tert-butyl-4-ethylphenol, 2,4-dimethyl-6-tert-butyl-phenol, 2,6-di-tert-dimethylamino-p-cresol, 2,6-di-tert-4-(N,N'-di-methylaminomethylphenol), 4,4'-thiobis (2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-α-naphthylamine, and alkylated-α-naphthylamine. Other types of oxidation inhibitors include metal di-thiocarbamate (e.g., zinc di-thiocarbamate), and methylene bis(di-butyl di-thiocarbamate). The anti-oxidant is generally incorporated into an oil in an amount of about 0 to about 10 wt %, preferably 0.05 to about 3.0 wt %, per total amount of the engine oil.

Anti-Wear and Extreme Pressure Agents

As their name implies, these agents reduce wear of moving metallic parts. Examples of such agents include, but are not limited to, phosphates, phosphites, carbamates, esters, sulfur containing compounds, molybdenum complexes, zinc di-alkyl di-thiophosphate (primary alkyl secondary alkyl and aryl type), sulfurized oils, sulfurized isobutene, sulfurized polybutene, di-phenyl sulfide, methyl tri-chlorostearate, chlorinated naphthalene, fluoroalkylpolysiloxane, and lead naphthenate.

Rust Inhibitors (Anti-Rust Agents)

Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate.

Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

Demulsifiers

Addition product of alkylphenol and ethylene oxide, polyoxyethylene alkyl ether, and polyoxyethylene sorbitan ester.

Friction Modifiers

Fatty alcohols, 1,2-diols, borated 1,2-diols, fatty acids, amines, fatty acid amides, borated esters, and other esters.

Multifunctional Additives

Sulfurized oxymolybdenum di-thiocarbamate, sulfurized oxymolybdenum organo phosphoro-di-thioate, oxymolybdenum mono-glyceride, oxymolybdenum di-ethylate amide, amine-molybdenum complex compound, and sulfur-containing molybdenum complex compound.

Viscosity Index Improvers

Polymethacrylate type polymers, ethylene-propylene copolymers, styrene-isoprene copolymers, hydrogenated styrene-isoprene copolymers, polyisobutene, and dispersant type viscosity index improvers.

Pour Point Depressants

Polymethyl methacrylate.

Foam Inhibitors

Alkyl methacrylate polymers and dimethyl silicone polymers.

EXAMPLES

The super overbased mixture of polyalkenyl sulfonates and alkylaryl sulfonates of the invention were prepared as described in the Examples given below.

Example 1

Preparation of Stabilized Polyisobutene Sulfonic Acids

A polyisobutene sulfonic acid sample was stabilized by neutralization according to the procedures given in Example 3 of US Patent Application 2005/059560. A polyisobutene (PIB) feed having a number average molecular weight (Mn) of 450 (available from Texas Petrochemical LP as TPC 545) was sulfonated in a failing film reactor with $SO_3$ (sulfur trioxide) in air employing the following conditions:

The $SO_3$ was prepared by passing a mixture of $SO_2$ and air through a reactor containing a vanadium oxide catalyst.

$SO_3$/PIB molar ratio=1.01; feed temperature of 75° C.; reactor temperature=55° C.; $SO_3$/air temperature=50° C.; $SO_3$ concentration in air=4.1 volume %;

$SO_3$ loading=0.9 kilogram per hour per centimeter; PIB feed rate of 24 kilogram per hour; and a $SO_3$ flow rate of 4.31 kilogram per hour. The sulfonic acid content of the product exiting the sulfonator was 13.2 weight % on an $HSO_3^-$ (sulfonic acid) basis. The entire product stream from the failing film reactor was immediately neutralized with a 25 weight % lime (calcium hydroxide ($Ca(OH)_2$) in a solvent (100 Neutral oil) slurry flowing at a rate of 5.95 kilogram per hour. The overall degree of sulfonic acid neutralization by calcium was approximately 85 weight %.

Similarly, a stabilized PIB having a number average molecular weight (Mn) of 550 was prepared using the above procedures with one notable exception, the Mn 550 PIB was first diluted to 77.1 weight % with a Group 2 100 oil. The Mn 550 PIB was prepared by blending appropriate amounts of Mn 350 and Mn 750 PIB available from Texas Petrochemical LP as TPC 535 and TPC 575, respectively. Sulfonation reaction conditions for the Mn 550 PIB are as follows:

$SO_3$/PIB molar ratio=0.84; feed temperature of 90° C.; reactor temperature=78° C.; $SO_3$/air temperature=50° C.; $SO_3$ concentration in air=3.6 volume %;

$SO_3$ loading=0.8 kilogram per hour per centimeter; PIB feed rate of 31.3=kilogram per hour; and an $SO_3$ flow rate of 3.83 kilogram per hour.

The sulfonic acid content of the product exiting the failing film reactor was 7.5 weight % on an $HSO_3^-$ basis. The entire product stream from the failing film reactor was immediately neutralized with the 25 weight % lime (calcium hydroxide ($Ca(OH)_2$) in a solvent (100 Neutral oil) slurry flowing at a rate of 5.33 kilogram per hour. Again, the overall degree of sulfonic acid neutralization by calcium was approximately 85 weight %.

Comparative Example A

Comparative Example A was prepared using the Mn 450 stabilized polybutene sulfonic acid prepared in Example 1. The Mn 450 stabilized polybutene sulfonic acid was then overbased by first adding 310 grams of the Mn 450 stabilized polybutene sulfonic acid over 15 minutes to a 3.5 liter reactor which had been previously charged with 643 grams of xylene, 81 grams of methanol, and 98 grams of lime. All raw materials were at room temperature prior to the start of the sulfonic acid addition to the reactor. Reactor temperature rose to approximately 33° C. at the end of the stabilized polybutene sulfonic acid addition. The mixture was then agitated for another 15 minutes prior to cooling the reactor temperature back to 27° C.

When the reactor temperature reached 27° C., $CO_2$ was then bubbled into the reaction mixture through a dip tube which was below the liquid surface. A total of 22 grams of $CO_2$ was fed over a period of 40 minutes. After the $CO_2$ was charged, a slurry consisting of 198 grams of xylene, 81 grams of methanol, and 98 grams of lime was added rapidly to the reactor. The $CO_2$ feed rate was then increased to 0.87 grams per minute and the reaction mixture was carbonated for an additional 66 minutes. At the end of this carbonation period, another slurry of 139 grams of xylene and 49 grams of lime was rapidly charged to the reactor. Carbonation of the reactor contents then continued at a rate of 0.82 grams per minute for a period of 27 minutes. The $CO_2$ flow rate was then reduced to 0.31 grams per minute for a period of 37 minutes. Total carbonation time was 170 minutes during which time a total of 113 grams of $CO_2$ was charged to the reactor. During the carbonation step, reactor temperature was allowed to increase to 40° C. from the heat of reaction. Cooling was applied as necessary to maintain and to prevent the temperature from exceeding 40° C. After 40° C. was reached, reaction temperature was maintained between 38° C. and 40° C.

The methanol and water were distilled by ramping the temperature to 132° C. over 2.5 hours. After reaching 132° C., 151 grams of solvent (100 Neutral oil) was added. The reaction mixture was allowed to cool and then filtered. After filtration, the reaction mixture was returned to the reactor and then ramped to 205° C. over 2 hours to remove xylene. During the ramp to 205° C., the pressure was gradually reduced to 50 millimeters Hg. The reaction mixture was then held at 205° C. and 50 millimeters Hg for 5 minutes. The super overbased polybutene sulfonic acid had the following properties:

| | |
|---|---|
| TBN (mg KOH/gm) | 452 |
| Ca | 16.5 weight % |
| Sulfonic acid | 0.96 weight % on a calcium basis |
| 100° C. Viscosity (@425 TBN*) | 8496 cSt |

*The TBN of the super overbased polybutene sulfonic acid was adjusted to 425.

Comparative Example B

Comparative Example B was prepared as described above for the super overbased Mn 450 polyisobutene sulfonic acid in Comparative Example A. The overbasing procedure was used except with an alkylbenzene sulfonic acid, wherein the alkyl group was a linear chain alkyl group containing from about 20 carbon atoms to about 24 carbon atoms, in place of the stabilized polybutene sulfonic acid used in Comparative Example A. The alkylbenzene sulfonic acid had an $HSO_3^-$ of 13.8 weight %. The only changes to the procedures were to decrease the alkylbenzene sulfonic acid charge to 206 grams and to increase the charge of the solvent (100 Neutral oil) to 255 grams. The super overbased alkylbenzene sulfonic acid had the following properties:

| | |
|---|---|
| TBN (mg KOH/gm) | 434 |
| Ca | 16.6 weight % |
| Sulfonic acid | 0.92 weight % on a calcium basis |
| 100° C. Viscosity (@425 TBN*) | 82 cSt |

*The TBN of the super overbased alkylaryl sulfonic acid was adjusted to 425

Test Example 1-10

Preparation of Super Overbased Mixtures of Polyisobutene Sulfonates and Alkylbenzene Sulfonates Mixtures containing stabilized polyisobutene sulfonic acid (Mn 450 and Mn 550) were prepared by mixing the requisite quantities of each as described in Table I below. In all the mixtures listed in Table 1 below, the charges of stabilized PIB sulfonic acid and alkylbenzene sulfonic acid were adjusted to target a total sulfonic acid content of 0.9 weight % (on a calcium basis) in the final super overbased product at a reference TBN of 425. The percentages reported in Table 1 represent the percentage of the total sulfonic acid in the final super overbased product which was contributed from either stabilized PIB sulfonic acid or alkylbenzene sulfonic acid on a $HSO_3^-$ (sulfonic acid) basis.

TABLE I

| | Sulfonate in Mixture* | | |
|---|---|---|---|
| Example | 450 mw** Polyisobutene Sulfonate (wt %) | 550 mw** Polyisobutene Sulfonate (wt %) | Alkylaryl Sulfonate (wt %) |
| Comparative Example A | 100 | 0.0 | 0.0 |
| Comparative Example B | 0.0 | 0.0 | 100 |
| Test Example 1 | 20 | 0.0 | 80 |
| Test Example 2 | 20 | 0.0 | 80 |
| Test Example 3 | 40 | 0.0 | 60 |
| Test Example 4 | 80 | 0.0 | 20 |
| Test Example 5 | 80 | 0.0 | 20 |
| Test Example 6 | 90 | 0.0 | 10 |
| Test Example 7 | 0.0 | 10 | 90 |
| Test Example 8 | 0.0 | 20 | 80 |
| Test Example 9 | 0.0 | 30 | 70 |
| Test Example 10 | 0.0 | 50 | 50 |

*Based on $HSO_3^-$ (sulfonic acid).

**The Mn 450 and Mn 550 stabilized polyisobutene sulfonic acids were prepared as described above in Example 1.

The TBN and viscosity of the mixtures of super overbased polyalkenyl sulfonates (Mn 450) and alkylbenzene sulfonates obtained in Comparative Examples A and B and Test Examples 1-6 were obtained and are summarized in Table II below. The viscosity of the mixtures of super overbased polyisobutene sulfonates and alkylbenzene sulfonates was determined after adjusting the TBN of the mixtures to 425.

TABLE II

| Example | TBN | Viscosity* | Reduction in Viscosity (fold) |
|---|---|---|---|
| Comparative Example A | 452 | 8504 | NA |
| Comparative Example B | 434** | 99** | NA |
| Test Example 1 | 430 | 96 | 89 |
| Test Example 2 | 430 | 82 | 104 |
| Test Example 3 | 437 | 86 | 99 |
| Test Example 4 | 453 | 144 | 59 |
| Test Example 5 | 446 | 119 | 72 |
| Test Example 6 | 448 | 490 | 17 |

*The TBN of Comparative Examples A and B and Test Examples 1-6 was adjusted to TBN 425 to compare the viscosity of the mixture of polyisobutene sulfonates and alkylaryl sulfonates.

**The TBN and the viscosity data were obtained by taking the average of the data from four separate experiments.

NA Not applicable.

The data summarized in Table II above shows that the process of the present invention provides super overbased mixtures of polyisobutene sulfonates and alkylaryl sulfonates having very high TBN, greater than 400, and very low viscosities.

Comparative Example A containing 100 weight percent super overbased polyisobutene sulfonate (Mn 450) has an extremely high viscosity which is not commercially practical. The data summarized in Table II show that the addition of increasing amounts of the alkylbenzene sulfonate to the polyisobutene sulfonates during the overbasing process results in a large reduction in viscosity of the super overbased polyisobutene and alkylbenzene sulfonate mixture.

The reduction in viscosities of Test Examples 1-6 were calculated by dividing the viscosity of the overbased polyisobutene sulfonate in Comparative Example A by the viscosity observed for each of the Test Examples 1-6.

The reduction in the viscosity of the super overbased polyisobutene sulfonate prepared from 450 molecular weight polyisobutene gave between 17 fold to 104 fold reduction in viscosity.

As discussed above, Comparative Examples A containing 100 weight percent super overbased polyisobutene sulfonates has an extremely high viscosity which is not commercially practical. The data show that the addition of increasing amounts of the alkylbenzene sulfonate to the polyisobutene sulfonates during the overbasing process results in a large reduction in viscosity of the super overbased polyisobutene and alkylbenzene sulfonate mixture. This reduction in viscosity is best seen in FIG. 1 which is a graphical representation of the data in Table II.

The TBN and viscosity of the mixtures of super overbased polyalkenyl sulfonates (Mn 550) and alkylbenzene sulfonates in Test Examples 7-10 were obtained and are summarized in Table III below.

TABLE III

| Example | TBN | Viscosity* |
|---|---|---|
| Test Example 7 | 416 | 127 |
| Test Example 8 | 440 | 162 |
| Test Example 9 | 459** | 178** |
| Test Example 10 | 446** | 344** |

*The TBN of Test Examples 6-10 was adjusted to TBN 425 to compare the viscosity of the mixture of polyisobutene sulfonates and alkylaryl sulfonates.
**The TBN and the viscosity data were obtained by taking the average of the data from two separate experiments.

The viscosity data obtained for the mixtures of super overbased polyisobutene sulfonates and alkylbenzene sulfonates in Test Examples 7-10 are summarized in Table III above. The viscosity of the mixtures was determined after adjusting the TBN of the mixtures to 425. The data show that the viscosity of the mixture of super overbased polyisobutene sulfonates and alkylbenzene sulfonates increased with increasing amounts of the stabilized polyisobutene sulfonic acid in the mixture. Test Examples 7, which had the lowest viscosity of 127 cSt at 100° C., contained only 10 weight percent stabilized polyisobutene sulfonic acid, while Test Example 10, which contained 80 percent weight percent stabilized polyisobutene sulfonic acid, had a viscosity of 325 cSt at 100° C.

The reduction in the viscosity of Test Examples 7-10 compared to the 100 weight percent super overbased Mn 550 polyisobutene sulfonate was not determined.

The reduction in viscosity observed for mixtures of super overbased polyisobutene (Mn 450 and Mn 550) and alkylbenzene sulfonates is best seen in FIG. 1 which is a graphical representation of the data in Tables II and III.

Surprisingly, a relatively small amount of alkylbenzene sulfonic acid drastically reduces the viscosity of super overbased sulfonates produced from only PIB sulfonic acids. In the case of Mn 450 stabilized PIB sulfonic acid, the viscosity decreased by 17 fold when arylalkyl sulfonic acid accounted for only 10% of the total sulfonic acid content.

What is claimed is:

1. A process for preparing a super overbased polyisobutene sulfonate and alkylbenzene sulfonate composition comprising (a) one or more super overbased polyisobutene sulfonates and (b) one or more super overbased alkylbenzene sulfonates, wherein the process comprises: (a) preparing a mixture of (i) one or more polyisobutene sulfonic acids, stabilized polyisobutene sulfonic acids, or mixtures thereof and (ii) one or more alkylbenzene sulfonic acids, stabilized alkybenzene sulfonic acids, or mixtures thereof; (b) reacting the mixture in (a) with a source of an alkaline earth metal, a $C_1$ to $C_5$ alkanol and carbon dioxide in the presence of a solvent; wherein the Total Base Number (TBN) of the sulfonate composition is greater than 400 and wherein the ratio of super overbased polyisobutene sulfonates to super overbased alkylbenzene sulfonates based on percentage of the total sulfonic acid in the super overbased polyisobutene sulfonate and alkylbenzene sulfonate composition which was contributed from the polyisobutene sulfonates and alkylbenzene sulfonates on a sulfonic acid basis is from about 1:9 to about 9:1 and further wherein the super overbased polyisobutene sulfonate and alkylbenzene sulfonate composition has a viscosity in the range from about 60 to about 500 cSt at 100° C.

2. The process of claim 1, wherein the super overbased polyisobutene solfonate and alkylbenzene sulfonate composition has a TBN greater than 425.

3. The process of claim 2, wherein the super overbased polyisobutene sulfonate and alkybenzene sulfonate composition has a TBN greater than 450.

4. The process of claim 1, wherein the alkaline earth metal is calcium.

5. A lubricating oil composition comprising: (a) a major amount of an oil of lubricating viscosity; and (b) a super overbased polyisobutene sulfonate and alkylbenzene sulfonate composition comprising (i) one or more super overbased polyisobutene sulfonates and (ii) one or more super overbased alkylbenzene sulfonates; wherein the super overbased polyisobutene sulfonate and alkylbenzene sulfonate composition in (b) is prepared using the process in claim 1 and wherein the Total Base Number (TBN) of the sufonate composition is greater than 400 and wherein the ratio of super overbased polyisobutene sulfonates to super overbased alkylbenzene sulfonates based on percentage of the total sulfonic acid in the super overbased polyalkenyl sulfonate and alkylaryl sulfonate composition which was contributed from the polyisobuene sulfonates and alkylbenzene sulfonates on a sulfonic acid basis is from about 1:9 to about 9:1 and further wherein the super overbased polyisobutene sulfonate and alkylbenzene sulfonate composition has a viscosity in the range from about 60 to about 500 cSt at 100° C.

6. The lubricating oil composition of claim 5, wherein the super overbased polyisobutene sulfonate and alkylbenzene sulfonate composition in (b) has a TBN greater than 425.

7. The lubricating, oil composition of claim 6, wherein the super overbased polyisobutene sulfonate and alkylbenzene sulfonate composition in (b) has a TBN greater than 450.

8. A lubricatina, oil concentrate comprising: (a) from about 10 weight percent to about 90 weight percent of an oil of lubricating viscosity; and (b) a super overbased polyisobutene sulfonate and alkylbenzene sulfonate composition comprising (i) one or more super overbased polyisobutene sulfonates and (ii) one or more super overbased alkylbenzene sulfonates; wherein the super overbased polyisobutene sulfonate and alkylbenzene sulfonate composition in (b) is prepared using the process in claim 1 and wherein the Total Base Number (TBN) of the sulfonate composition is greater than 400 and wherein the ratio of super overbased polyisobutene sulfonates to super overbased alkylbenzene sulfonates based on percentage of the total sulfonic acid in the super overbased polyisobutene sulfonate and alkylbenzene sulfonate composition which was contributed from the polyisobutene sulfonates and alkylbenzene sulfonates on a sulfonic acid basis is from about 1:9 to about 9:1 and further wherein the super overbased polyisobutene sulfonate and alkylbenzene sulfonate composition has a viscosity in the range from about 60 to about 500 cSt at 100° C.

9. The lubricating oil concentrate of claim 8, wherein the super overbased polyisobutene sulfonate and alkylbenzene sulfonate composition in (b) has a TBN greater than 425.

10. The lubricating, oil concentrate of claim 9, wherein the super overbased polyisobutene sulfonate and alkylbenzene sulfonate composition in (b) has a TBN greater than 450.

11. The process of claim 1, wherein the ratio of super overbased polyisobutene sulfonates to super overbased alkylbenzene sulfonates based on percentage of the total sulfonic acid in the composition which was contributed from the polyisobutene sulfonates and alkylbenzene sulfonates on a sulfonic acid basis is from about 1:4 to about 4:1.

12. The lubricating oil composition according to claim 5, wherein the ratio of super overbased polyisobutene sulfonates to super overbased alkylbenzene sulfonates based on percentage of the total sulfonic acid in the composition which was contributed from the polyisobutene sulfonates and alkylbenzene sulfonates on a sulfonic acid basis is from about 1:4 to about 4:1.

13. The lubricating oil concentrate according to claim 8, wherein the ratio of super overbased polyisobutene sulfonates to super overbased alkylbenzene sulfonates based on percentage of the total sulfonic acid in the composition which was contributed from the polyisobutene sulfonates and alkylbenzene sulfonates on a sulfonic acid basis is from about 1:4 to about 4:1.

* * * * *